US006129221A

United States Patent [19]

Shaha

[11] Patent Number: 6,129,221

[45] Date of Patent: Oct. 10, 2000

[54] MODULAR STORAGE RACK SYSTEM

[76] Inventor: Kevin B. Shaha, Box 297, Laclede, Id. 23841

[21] Appl. No.: 09/124,564

[22] Filed: Jul. 29, 1998

[51] Int. Cl.[7] ..... A47B 96/07; A47F 5/08

[52] U.S. Cl. ..... 211/87.01; 248/313; 248/221.11; 248/222.11; 211/89.01

[58] Field of Search ..... 211/87.01, 89.01, 211/4; 248/221.11, 222.11, 313, 312, 312.1, 311.2; 220/476; 40/648; 47/39; D8/373; D6/407

[56] References Cited

U.S. PATENT DOCUMENTS

| | | | |
|---|---|---|---|
| Re. 23,173 | 11/1949 | Gunther | 248/313 X |
| D. 257,948 | 1/1981 | Klingensmith | D8/373 |
| D. 330,648 | 11/1992 | Lippert | D6/407 X |
| 412,499 | 10/1889 | Hamilton | 248/221.11 |
| 813,537 | 2/1906 | Townsend | 248/222.11 |
| 2,041,566 | 5/1936 | Mischler | 206/476 X |
| 2,127,230 | 8/1938 | Moineau | 248/222.11 |
| 2,266,294 | 12/1941 | Allderdice | 248/313 X |
| 2,327,969 | 8/1943 | Sanford | 206/476 X |
| 2,499,672 | 3/1950 | Nurkiewicz | 248/313 |
| 2,505,097 | 4/1950 | Collins | 248/313 |
| 2,587,912 | 3/1952 | Simpson | 248/221.11 |
| 2,734,711 | 2/1956 | Shippen | 248/313 |
| 2,877,976 | 3/1959 | Massari | 248/313 |
| 2,936,149 | 5/1960 | Reeg | 248/313 |
| 3,491,820 | 1/1970 | Ostling | 248/222.11 X |
| 4,071,976 | 2/1978 | Chernewski | 248/313 X |
| 4,113,217 | 9/1978 | O'Connell | 248/221.11 X |
| 4,386,721 | 6/1983 | Shimano | 248/313 X |
| 4,422,610 | 12/1983 | Hunt | 47/39 X |
| 4,623,113 | 11/1986 | Studebaker | 248/313 X |
| 4,805,861 | 2/1989 | Thalenfeld et al. | 248/221.11 X |
| 5,069,407 | 12/1991 | Williams | 248/221.11 X |
| 5,348,268 | 9/1994 | Klein | 248/222.11 X |
| 5,435,512 | 7/1995 | Rudy, Jr. et al. | 248/221.11 X |
| 5,494,246 | 2/1996 | McCarthy et al. | 248/221.11 |
| 5,820,091 | 10/1998 | Kutscher | 248/222.11 X |

*Primary Examiner*—Daniel P. Stodola
*Assistant Examiner*—Khoa Tran
*Attorney, Agent, or Firm*—Bennet K. Langlotz PC; Bennet K. Langlotz

[57] ABSTRACT

A wall mounted equipment storage rack system having a wall mounted anchor, and a number of different rack modules with a common interface for mounting to the anchor. The anchor includes a fastener for securing it to a wall. The anchor may have a flat oblong profile with rounded ends for mating with a similar oblong hole in each rack module. The anchor may include a spring latch for securing the rack to the anchor, and for releasing the rack to enable removal and replacement of the rack.

13 Claims, 5 Drawing Sheets

3
36
102
88
105
12
54
82
102
90
84
80
60
40
3
36′
52
86
94
92
104
70
76
72
36′
62
42
104
74
50

MODULAR STORAGE RACK SYSTEM

FIELD OF THE INVENTION

The invention relates to equipment storage, and more particularly to wall mounted rack systems.

BACKGROUND AND SUMMARY OF THE INVENTION

Wall mounted racks have commonly been used for storage of household goods. Typical wall mounted racks have a flat base plate or frame that is secured to a vertical wall surface. The base plate or frame typically has several through holes, through which screws or bolts are driven into a structural member in the wall.

To serve a wide range of functions, there are many different types of specialized racks. For instance, for household storage of sporting and recreational goods, numerous different rack elements may be attached to the support plate. Such elements may be used for supporting skis, bicycles, golf clubs, footwear, balls, and innumerable other equipment, the rack elements may include protruding rods, bars, shelves, hooks, baskets, and other elements, sized and shaped for storage of particular items.

In many households, wall space is limited in spaces such as garages where sporting equipment is stored. Because many activities are seasonal in nature, ready access to some equipment is not required year round. The storage of out-of-season equipment in convenient places limits the pace for in-season equipment, and the specialized racks for one season's gear are unlikely suitable for another season's gear. Further, the secure mounting fasteners needed for supporting heavier items make it impractical to readily remove and replace racks on a seasonal basis. Such would leave unsightly holes, and would provide weaker support as bolt holes are reused after several seasons.

The embodiment disclosed herein overcomes these disadvantages by providing a wall mounted equipment storage rack system having a wall mounted anchor, and a number of different rack modules with a common interface for mounting to the anchor. The anchor includes a fastener for securing it to a wall. The anchor may have a flat oblong profile with rounded ends for mating with a similar oblong hole in each rack module. The anchor may include a spring latch for securing the rack to the anchor, and for releasing the rack to enable removal and replacement of the rack.

DETAILED DESCRIPTION OF A PREFERRED EMBODIMENT

Figure 1:
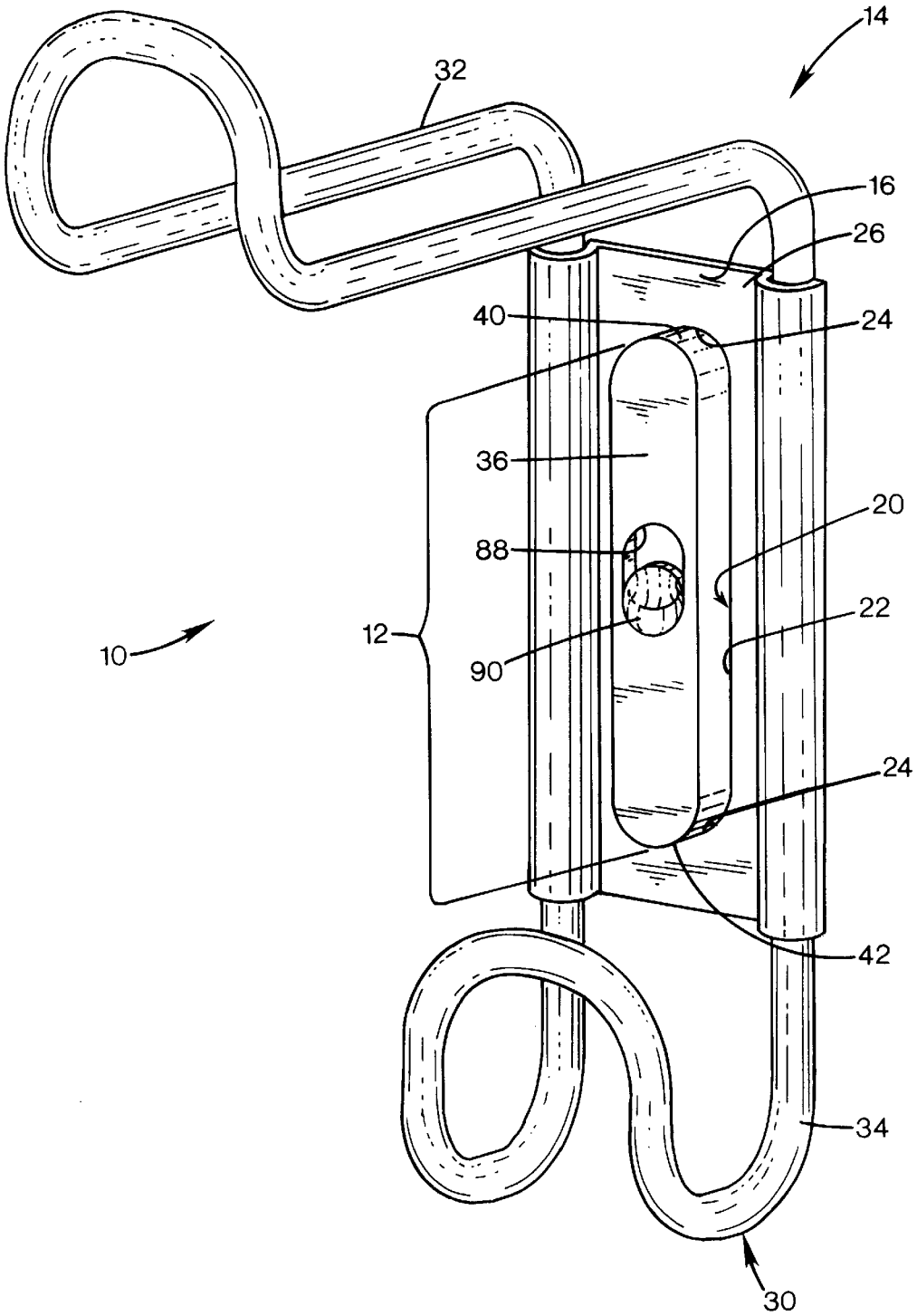
FIG. 1 is a perspective view of a wall mounted equipment rack and anchor according to a preferred embodiment of the invention.

FIG. 1 shows a wall mounted equipment rack system 10 including a wall mounted anchor 12 and a removable rack element 14.

The rack element has a flat rectangular mounting plate 16 formed of sheet steel, and defining an oblong aperture 20. The aperture has parallel elongated side portions 22, and semicircular ends 24. In the preferred embodiment, the aperture is 1 inch wide and 4 inches long. The plate has opposed side channel portions 26 formed to define U-shaped channels that open concavely toward the rear face of the plate, and which protrude convexly toward the front of the plate, away from the wall on which the anchor is mounted. Each channel runs parallel to the axis of the aperture, along the entire length of the vertical plate edges. The plate is common to many or all such rack elements. A bent steel rod 30 is formed to a shape having parallel spaced apart intermediate portions received in the channel portions, with an upper portion 32 of the rod extending from the upper ends of the channels, and a lower portion 34 extending downwardly form the lower ends. In the illustrated embodiment, the rack has an upper portion loop with parallel sides and an upturned loop end suitable for storing bicycles, rakes, coiled cords, and numerous other items. A lower portion has an upturned loop closer to the wall surface, and suitable for hanging smaller objects.

The anchor 12 is a generally planar elongated body, with a peripheral profile sized and shaped to closely fit within the aperture of the rack element. The components of the anchor are formed by the injection molding of reinforced thermoplastic. A front surface 36 of the anchor is parallel to the rear surface, which is mounted against the wall. An upper end 40 supports the weight of the rack element and its contents, and an opposed lower end 42 has an extendible latch as will be discussed below. A release button 90 passes through an aperture 88 defined in the front surface 36.

Figure 2:
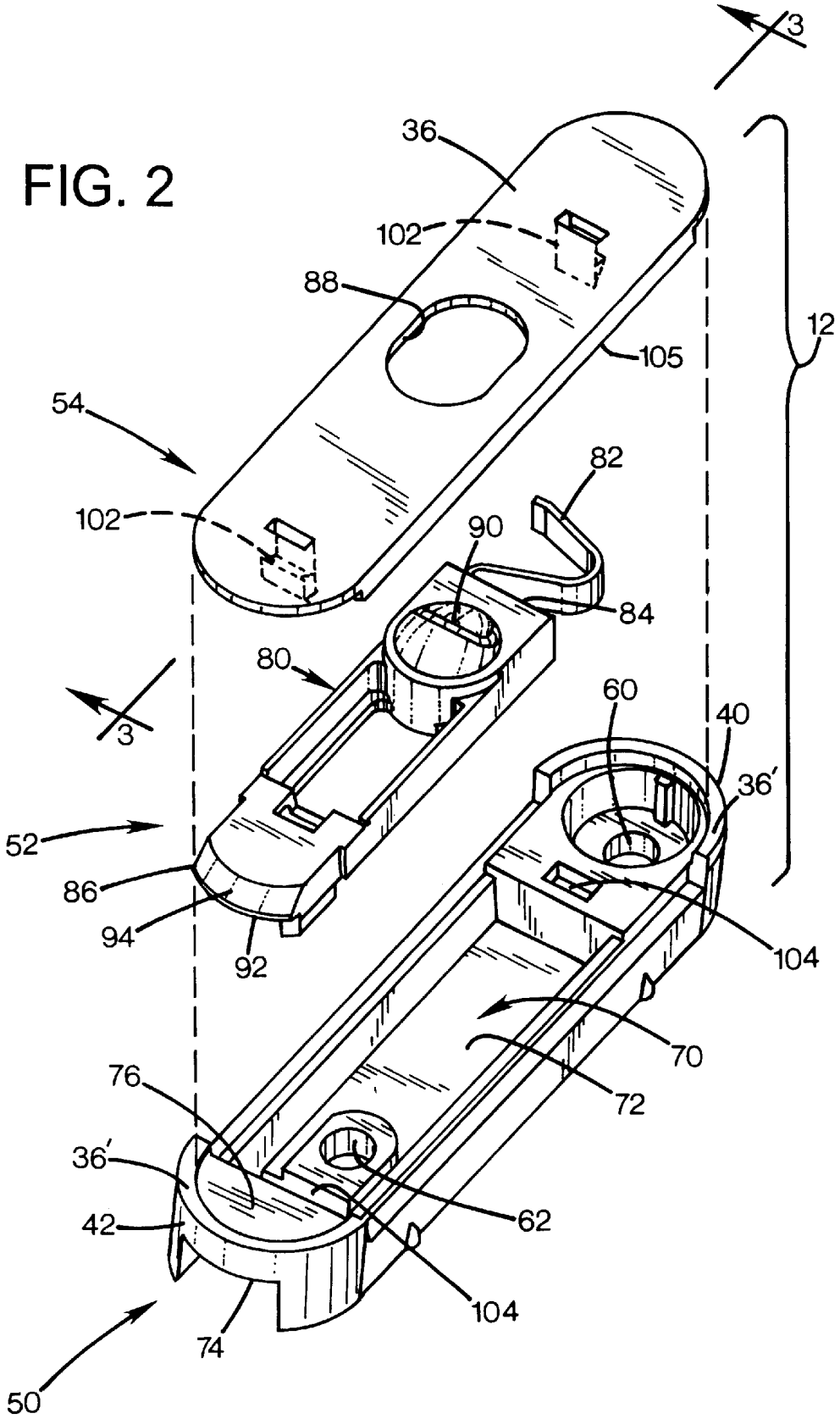
FIG. 2 is an exploded perspective view of the anchor of the embodiment of FIG. 1.
Figure 3:
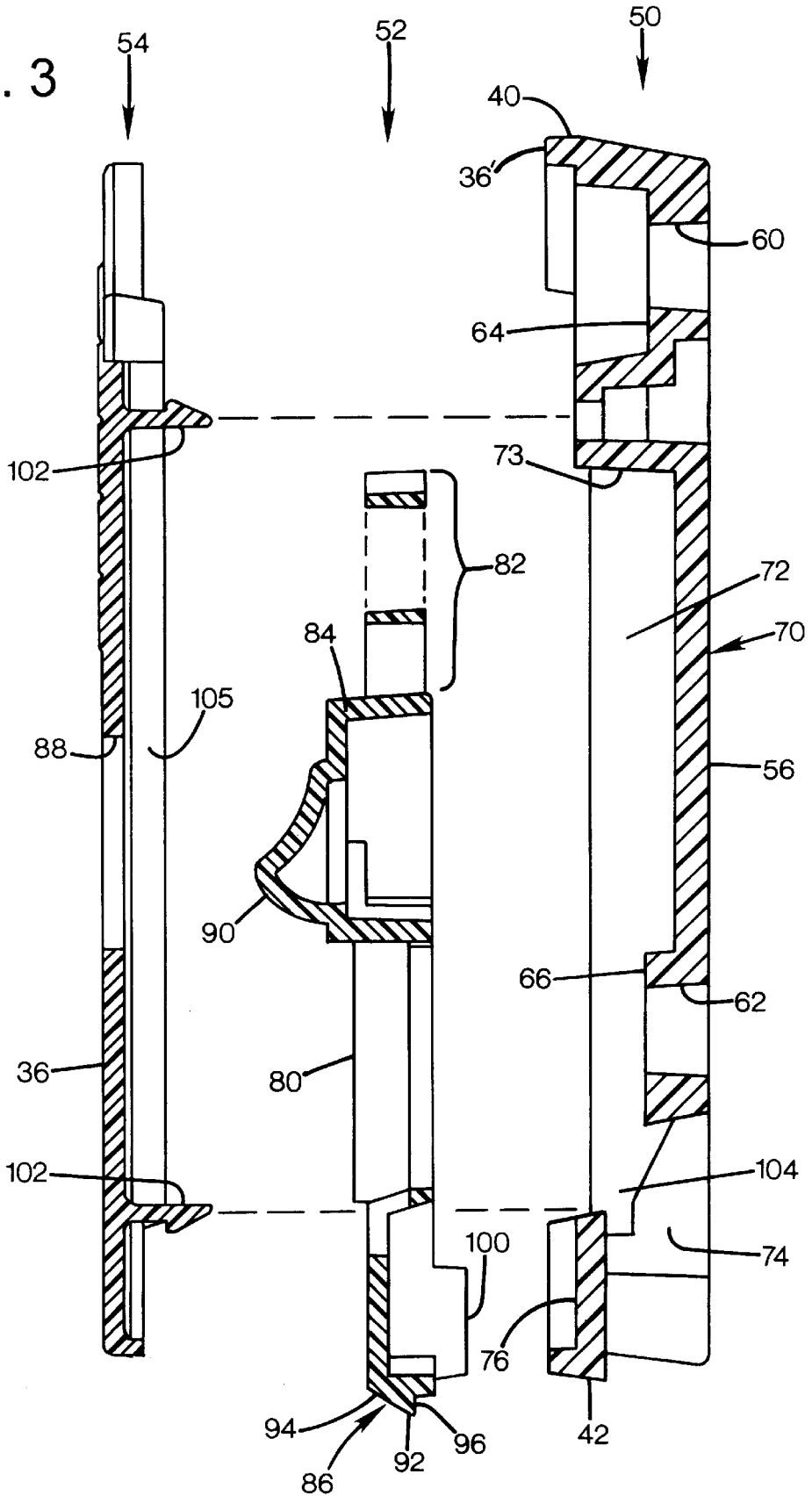
FIG. 3 is a sectional exploded side view of the anchor of the embodiment of FIG. 1 taken along line 3—3 of FIG. 2.

As shown in FIGS. 2 and 3, the anchor 12 includes a base portion 50, a latch portion 52, and a cover 54. The base portion 50 is a unitary part that provides the periphery of the anchor, as well as the rear surface 56. It has a thickness from the front surface rims 36' to the rear surface 56 defining the overall thickness of the anchor. A pair of mounting through holes 60, 62 are provided near the opposite ends 40, 42, each having an upper surface 64, 66 recessed below the upper surface 36'. A major intermediate portion of the base has a rear wall 70 recessed from the front rim to define a pocket 72 that is bounded at the upper end by an end wall 73. The pocket extends toward the lower end 42 of the base, where it connects to a lower pocket 74 that is open to the rear of the base, and covered by a lower front panel 76.

The latch portion 52 is an elongated body having a length and width smaller than that of the base portion 50. The latch has a rigid body 80 having an integral spring portion 82 attached at a first end 84, and having an opposed latch end 86. A button 90 protrudes forwardly from the latch portion. The spring portion 82 is a curved articulated tongue formed of a flat wall oriented on edge relative to the plane of the anchor. The latch end 86 includes a nose 92 having a curved profile matching the radius of the anchor end, with an angled cam surface 94 facing downward and away from the rear direction at a 45 degree angle to the plane of the anchor. A rear-facing shoulder 96 beneath the cam surface at the latch end 86 is spaced apart from a rearmost surface 100 at the latch end.

The cover portion 54 is a flat plate having a profile similar to but slightly smaller than that of the base 50. The cover defines a central hole 88 sized to receive the latch button 90 over a small range of motion along the length of the anchor. A pair of resilient snap arms 102 extend rearwardly from spaced apart positions near the cover ends, in registration with snap apertures 104 in the base. The snap arms have tapered ends with a sharp shoulder that engages respective ledges in the apertures 104 to facilitate installation and to resist removal. Side flanges 105 extend rearward from the straight sides of the cover to mate with the base for an enclosed anchor surface, as will be discussed below.

Figure 4:
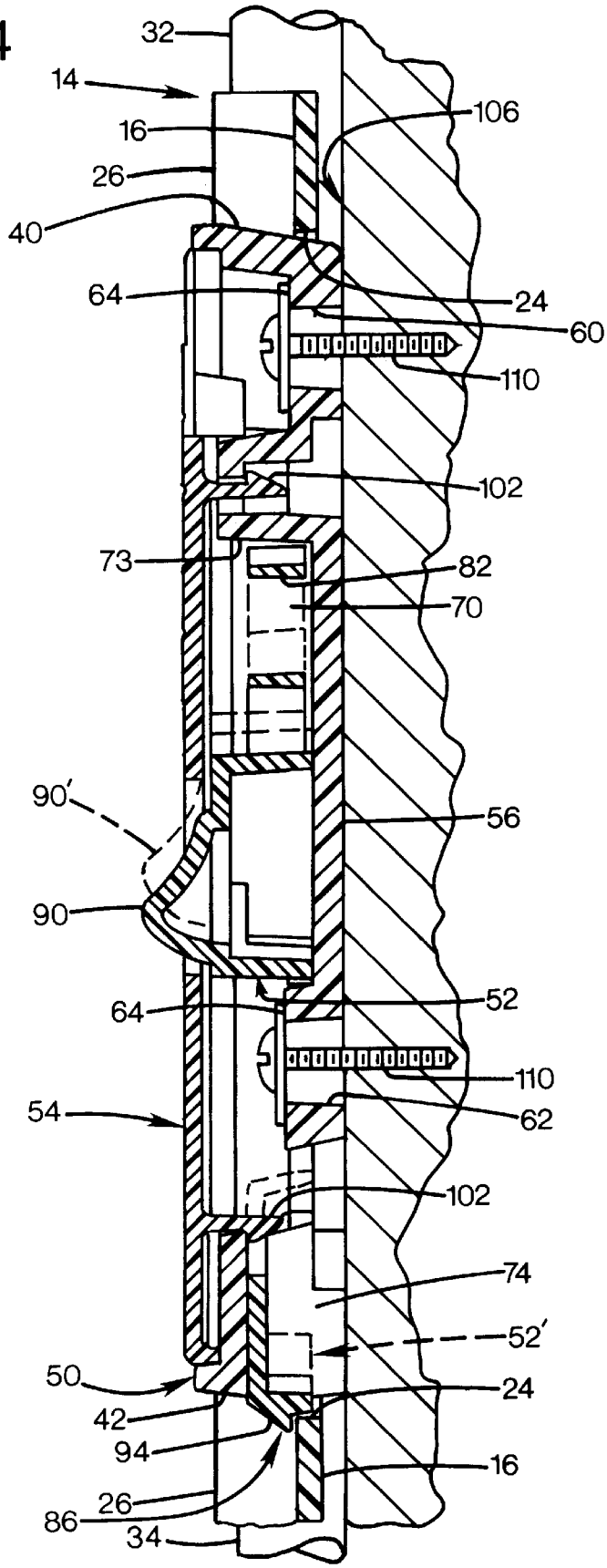
FIG. 4 is a sectional side view rack and anchor as installed.

As shown in FIG. 4. the base is secured to a vertical wall surface 106 defining a mounting plane. The rear surface is positioned directly against the wall, with bolts 110 passing through holes 60, 62 and into the wall. Bolt heads and washers rest against surfaces 64, 66. The latch portion 52 is received in the pocket 70, with the end of spring 82 contacting and biased against wall 73. The latch end extends through the lower pocket 74, with surfaces 100 resting against the wall surface. As illustrated in solid lines, the latch portion is in an extended position in which the latch end 86 extends beyond the lower end 42 of the base. In this position, the entire cam 25 surface 94 and shoulder 96 extend beyond the lower base end 42. The cover 54 is attached to the base, enclosing the front and side edge surfaces. The button 90 protrudes through hole 88, with the button being near a lower end of the hole in the illustrated position.

The latch is movable to a retracted position 52' in which the latch end 86 is retracted into the lower pocket 74 so that the cam surface 94 and shoulder 96 do not extend beyond the body's lower end 42. In the retracted position, the latch spring 82 is compressed against the end wall 73. To move the latch into the retracted position, the buttons is manually shifted upward to position 90', compressing the spring. Due to the spring force, the latch will return to the extended position when the button is released.

The body's upper end 40 has a slight taper, so that the semicircular end is actually a frustoconical surface, widest at the front surface, and narrowest at the rear surface against the wall 106. Thus, with the aperture 24 placed about the anchor in the installed position shown, with the rack element 14 placed against the wall, the downward force of the rack will tend to maintain the rack stably against the wall. In the installed position, the latch end 86 extends beyond the aperture end 42, with shoulder 96 preventing the lower end of the mounting plate from being lifted away from the wall. To install the mounting plate on a wall mounted anchor, the upper end of the aperture 20 is placed over the upper end of the anchor, with the upper portion of the mounting plate against the wall. The lower portion of the mounting plate is moved toward the wall, with the lower end 24 of the aperture pressing against the cam surface 94 to drive the latch into the body as the lower part of the is moved against the wall. When this occurs, the latch springs back to the extended position. If desired, the button may be shifted upward during installation, reducing frictional forces and wear on the cam surface. Because the lower pocket 74 has a limited width, the lower end of the base has adequate support at the curved portions adjacent the wall and adjacent the pocket, to prevent the rack from being lifted upward and inadvertently released. In addition, the undercut slope at the top prevents the upper end of the rack from being tilted forward away from the wall.

Figure 5:
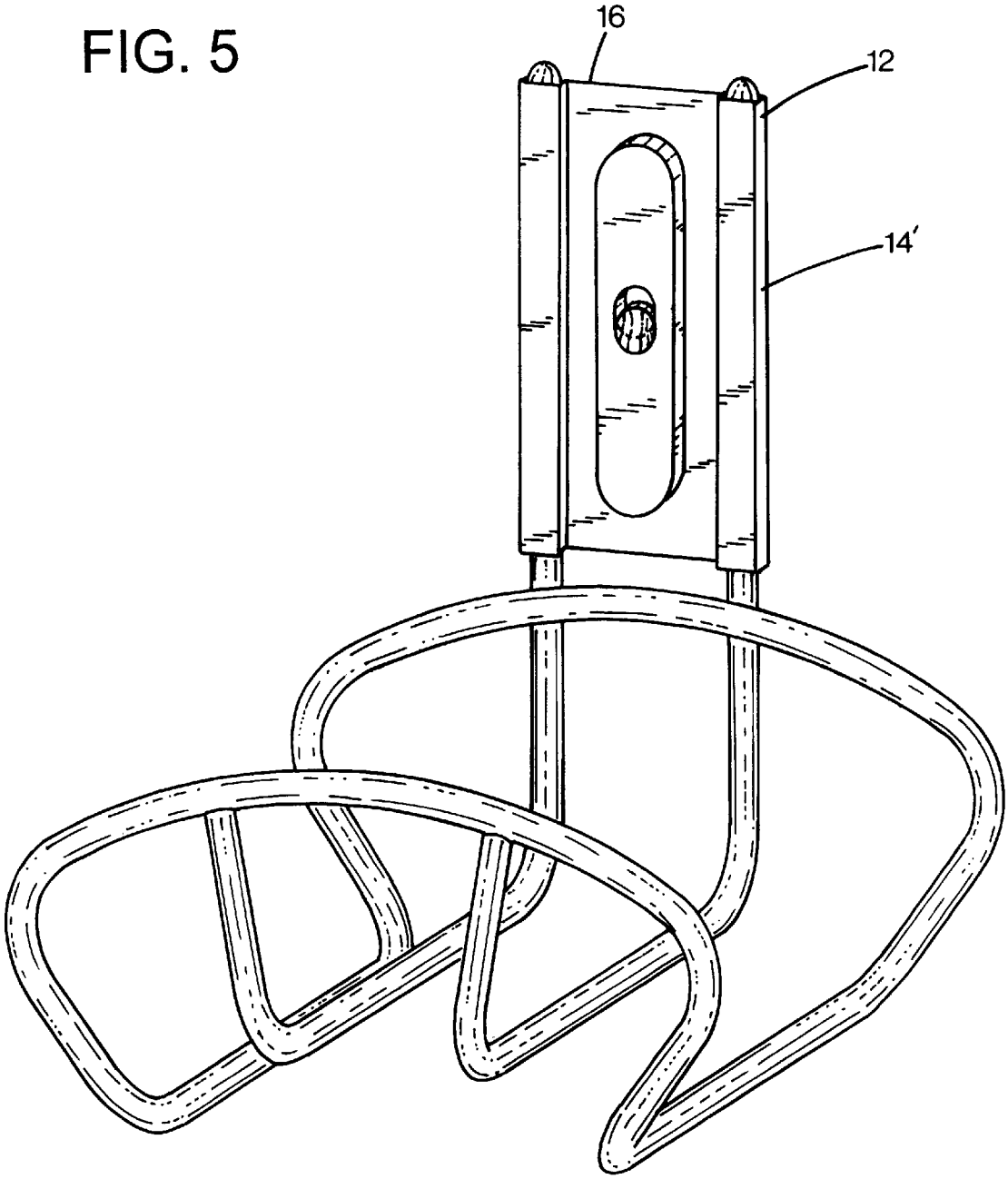
FIG. 5 is a perspective view of an alternative wall mounted rack with the anchor of FIG. 1.

As shown in FIG. 5, an alternative rack 14' is mounted to the standard anchor. With the standard mounting plate 16, attachment and removal proceed by the same process as described above. However, the bent rod or wire portion of the rack is designed for a different purpose, in this case for carrying a garden hose. Innumerable different rack configurations employing the same mounting arrangement may be provided. Such racks may be sold in kits with one rack and one anchor, or in kits with more anchors than racks or vice versa. Extra racks and anchors may be sold independently.

In typical usage, the anchors are permanently mounted in a convenient location such as a garage. Seasonally, racks associated with seasonal needs are installed, replacing racks associated with out of season activities. In some applications, one set of anchors may be installed in a readily accessed location for in-season storage, and other anchors may be located in a more remote storage facility. Seasonally, the racks are switched so that current equipment may be stored conveniently.

While the disclosure is made in terms of a preferred embodiment, the invention is not intended to be so limited. For instance, the racks are not limited to recreational or household goods, but may be employed for industrial storage such as for tools, and commercial display, such as for product and garment display racks.

What is claimed is:

1. A wall mounted equipment storage rack system comprising:

an elongated anchor defining an axis and having opposed ends;

the anchor having a fixed portion and a movable latch portion movable along the axis between a retracted position and an extended position;

the latch portion extending beyond the fixed portion when the latch is in the extended position;

a fastener for securing the anchor to a vertical wall to support a load;

a rack having an interface element defining an aperture sized to encompass at least a portion of the anchor, and detachably connectable to the anchor; and the rack having an equipment support portion extending from the interface element.

2. The system of claim 1 wherein the latch is spring biased to the extended position.

3. The system of claim 2 wherein the anchor includes a metal sheet defining the aperture.

4. The system of claim 2 wherein the aperture has an elongated profile with opposed parallel sides.

5. The system of claim 2 wherein the aperture has an elongated profile with radiused ends.

6. The system of claim 1 wherein the latch element is spring biased.

7. The system of claim 1 wherein the anchor defines a wall contact plane, and includes an elongated body extending parallel to the plane and having a fixed first end and wherein the latch portion comprises a movable second end opposite the first end.

8. The system of claim 1 wherein substantially all the anchor is encompassed by the aperture.

9. A wall mounted anchor for supporting an equipment storage rack having a plate defining an attachment aperture, the anchor comprising:

an elongated fixed base portion having a first end and a second end and defining a mounting plane;

the base portion defining a fastener hole having an axis intersecting the mounting plane;

fastener means extending through the hole for securing the base portion in a fixed position to a surface;

a latch portion movably connected to the base portion;

the latch portion having a latch element movable between a first released position and a second latched position;

the latch portion having a latch end portion extending beyond the second end of the base portion when in the latched position, and the latch end portion being retracted toward the first end when in the released position.

10. The anchor of claim 9 wherein the anchor has an oblong profile.

11. The anchor of claim 10 wherein the anchor has radiused ends.

12. The anchor of claim 9 wherein the anchor is an elongated planar body.

13. The anchor of claim 9 wherein the latch is spring biased to the latched position.

* * * * *